United States Patent [19]

Schippers

[11] Patent Number: 4,771,701

[45] Date of Patent: Sep. 20, 1988

[54] PULLEY SUPPORT HEAD IN A CABLE CONVEYOR

[76] Inventor: Jacob Schippers, Z.I., Quartier Le Bresson, 38660 Le Touvet, France

[21] Appl. No.: 921,042

[22] PCT Filed: Feb. 24, 1986

[86] PCT No.: PCT/FR86/00059

§ 371 Date: Oct. 3, 1986

§ 102(e) Date: Oct. 3, 1986

[87] PCT Pub. No.: WO86/04870

PCT Pub. Date: Aug. 28, 1986

[30] Foreign Application Priority Data

Feb. 25, 1985 [FR] France ..... 85/02790

[51] Int. Cl.[4] ..... B61B 7/00

[52] U.S. Cl. ..... 104/197; 254/415

[58] Field of Search ..... 104/112, 115, 116, 117, 104/173.1, 173.2, 180, 196, 197; 254/415; 248/278

[56] References Cited

U.S. PATENT DOCUMENTS 3,128,992 4/1964 Luketa ..... 254/415
3,817,484 6/1974 Mundy ..... 248/278
3,902,701 9/1975 Orme ..... 254/415
4,358,089 11/1982 Metcalf ..... 254/415

FOREIGN PATENT DOCUMENTS 2227213 11/1974 France ..... 104/115

*Primary Examiner*—Robert B. Reeves
*Assistant Examiner*—Russell D. Stormer
*Attorney, Agent, or Firm*—Frost & Jacobs

[57] ABSTRACT

The pulley support head according to the invention is adapted to permit easy adjustment of the orientation of the pulley at any time, even when the pulley is turning.

The support head comprises a rigid frame (11) having a front extremity (13) which carries the pulley outside the frame, and mechanical means for pivoting this axle with respect to the frame on two substantially orthogonal axes (23, 40) defined by bearing edges provided on the frame. A first bearing edge (22) is situated in the front part of the frame. A threaded rod (27) articulated on the rear extremity (14) of the axle and connected to the frame by means of screws (31) permits pivoting the axle on the first edge (22). A guiding fork (34) defines a second pivoting axis (40) near to the rear extremity of the axle.

Such a support head may be utilized in any cable conveyor, for example a ski tow or a building site cableway.

9 Claims, 4 Drawing Sheets

PULLEY SUPPORT HEAD IN A CABLE CONVEYOR

BACKGROUND OF THE INVENTION

The present invention relates to a support head of a pulley over which a cable passes in a cable conveyor, this support head comprising a rigid frame and a pulley axle carried by this frame, a first extremity of this axle being adapted to serve as a pivot for the pulley outside the frame.

In cable conveyors, the pulleys supporting the mobile cable are pivotally mounted on support heads which are in general fixed at the extremity of a tubular arm mounted on a post or on any other fixed construction. To prevent the cable from getting out of the groove of the pulley, the latter must be as exactly as possible in the place determined by the two cable ends situated on both sides of the pulley. Now, when this plane is not vertical, the orientation of the pulleys must generally be adjusted once the cable has been set in place and appropriately stretched. To allow this adjustment, each support head is mounted on the tubular arm by means of a clamp assembly, which is made to pivot after having been loosened. One may likewise make the arm pivot on the post, or else an element of the arm on another tubular element, by means of another clamp assembly. However, these adjusting operations are long and difficult, because they necessitate relieving the pulley of the load exerted by the cable. In addition, since at least one of said clamp assemblies is necessarily at a certain distance from the pulley, any pivoting of this assembly leads to a substantial displacement of the pulley with respect to the post, which may appreciably modify the load distribution and necessitate reinforcement accordingly. It would thus be advantageous to be able to orient the pulley without substantially changing its place.

SUMMARY OF THE INVENTION

Consequently, the present invention has the object of providing a pulley support head permitting a fine adjustment of the orientation of the pulley to be effected, while the latter supports the cable, by simple and inexpensive means and without displacement of the support head.

To this end, the support head according to the present invention is characterized in that its frame is fixed and comprises mechanical means for pivoting the pulley axle pivot with respect to the frame on two substantially orthogonal pivoting axes.

According to a preferred embodiment of the invention, said pivoting axes are defined by bearing edges which are solid with the frame. The pulley axle advantageously presents a square or rectangular section in the zone of said bearing edges.

In this embodiment, the first pivoting axis is defined by a first bearing head situated in a front part of the frame, near to the pulley, while the mechanical means for pivoting the pulley axle on this first pivoting axis comprise a tie rod connected to the frame and to a second extremity of the pulley axle, and means for adjusting the length of this connecting rod and locking it. Said tie rod preferably comprises a threaded rod having one extremity articulated on the second extremity of the pulley axle and having the other extremity placed in an opening provided in an element of the frame, while said means for length adjustment and locking this tie rod comprise at least two screws mounted on this threaded rod so as to hold said frame element.

In the preferred embodiment, the pulley axle comprises, on its face arranged to bear upon the first bearing edge, stop means which are engaged against said bearing edge to fix the longitudinal position of the pulley axle. These stop means may comprise two studs fixed to the pulley axle, on both sides of the first bearing edge. The frame may further comprise a locking bar disposed parallel to the first bearing edge and on the other side of the pulley axle, so as to prevent said studs from passing over this edge.

In the preferred embodiment, the second pivoting axis is defined by a guiding fork solid with the frame and comprising two parallel bearing edges, substantially orthogonal with the first bearing edge and disposed respectively on both sides of the pulley axle for coming into contact with its lateral faces, the mechanical means for pivoting the pulley axle on the second pivoting axis comprising at least one lateral screw connecting the pulley axle to the frame. The guiding fork is preferably disposed near to the second extremity of the pulley axle, while the mechanical means for pivoting the pulley axle on the second pivoting axis comprise two opposed lateral screws which are mounted in threaded holes of the frame, parallel to the first pivoting axis and near to this axis, the extremities of these lateral screws bearing upon the lateral faces of the pulley axle.

The frame of the support head according to the invention may be realized entirely of welded and/or bent sheet metal. The frame preferably has the general form of a box and comprises a rear plate arranged for assembly with a fixed structure, two lateral plates, a frontal plate and at least one transverse plate, an edge of the frontal plate constituting the first bearing edge. Such a frame may comprise an element of bent sheet metal which at the same time constitutes the frontal plate and a transverse plate.

BRIEF DESCRIPTION OF THE DRAWING

The present invention and its advantages will be better understood by means of the description of a preferred embodiment given below by way of example with reference to the accompanying drawings, wherein.

DETAILED DESCRIPTION OF THE INVENTION

Figure 1:
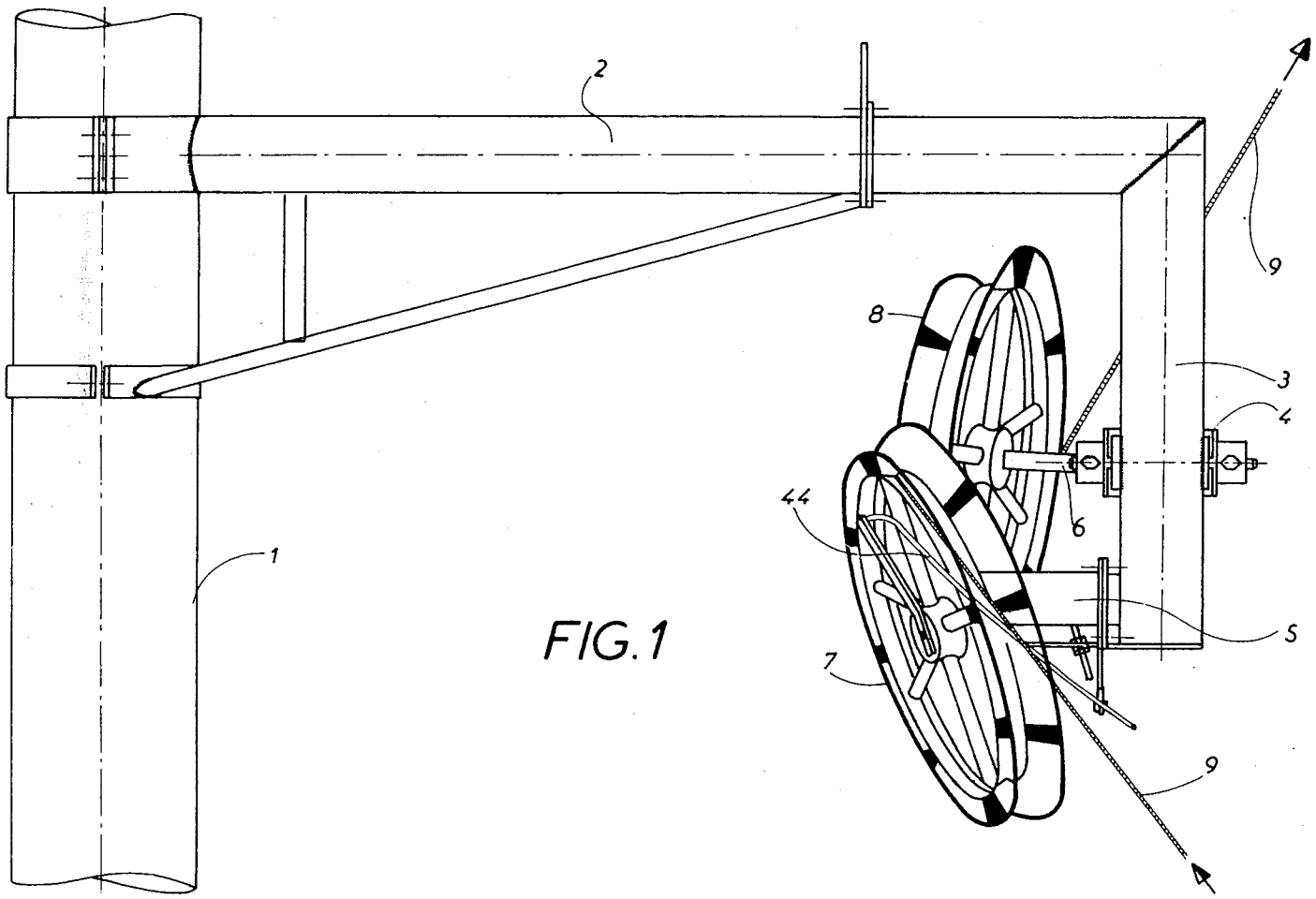
FIG. 1 is an elevation view of a support for two pulleys in a cable conveyor.

The support represented in FIG. 1 is well known in its general design. It comprises a post 1 on which a bracket 2 is fixed by means of a clamp assembly, an elbowed arm 3 fixed to the extremity of the bracket 2, a horizontal arm 4 fixed to the elbowed arm 3 by means of another clamp assembly, and two pulley support heads 5 and 6. Each of these support heads comprises an axle provided with a pivot for a respective pulley 7, 8. In the example represented in FIG. 1, the first support head 5 is mounted directly on the elbowed arm 3 while the second support head 6 is mounted on the horizontal arm 4. A cable 9 is displaced longitudinally while passing over the two pulleys 7 and 8, on each of which it forms an angle which is generally not situated in a vertical plane. The axis of rotation of each of the pulleys thereby generally forms an angle which is not a right angle with the axis of the arm carrying it.

Figure 2:
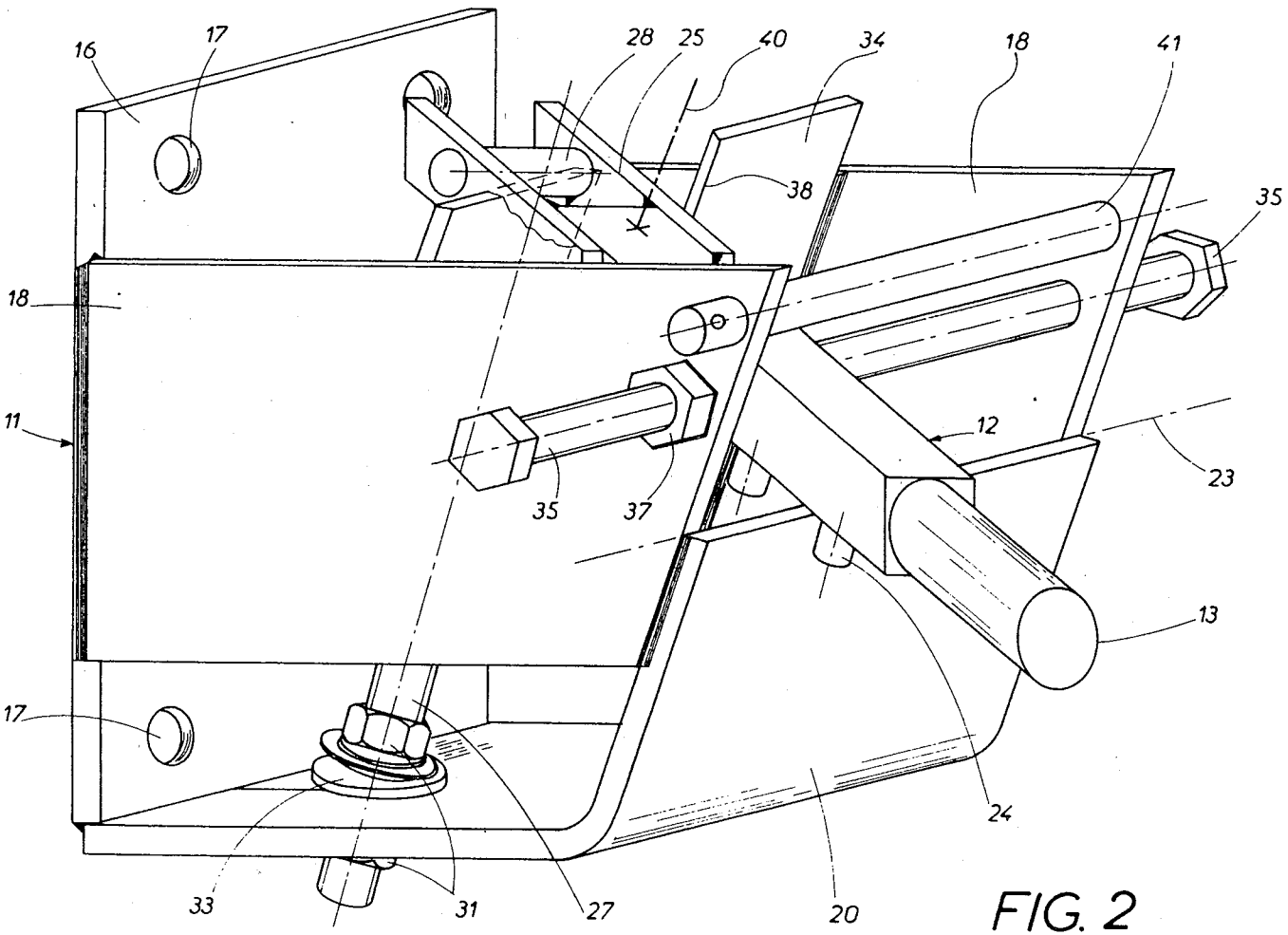
FIG. 2 is a perspective view of a support head according to the invention.
Figure 3:
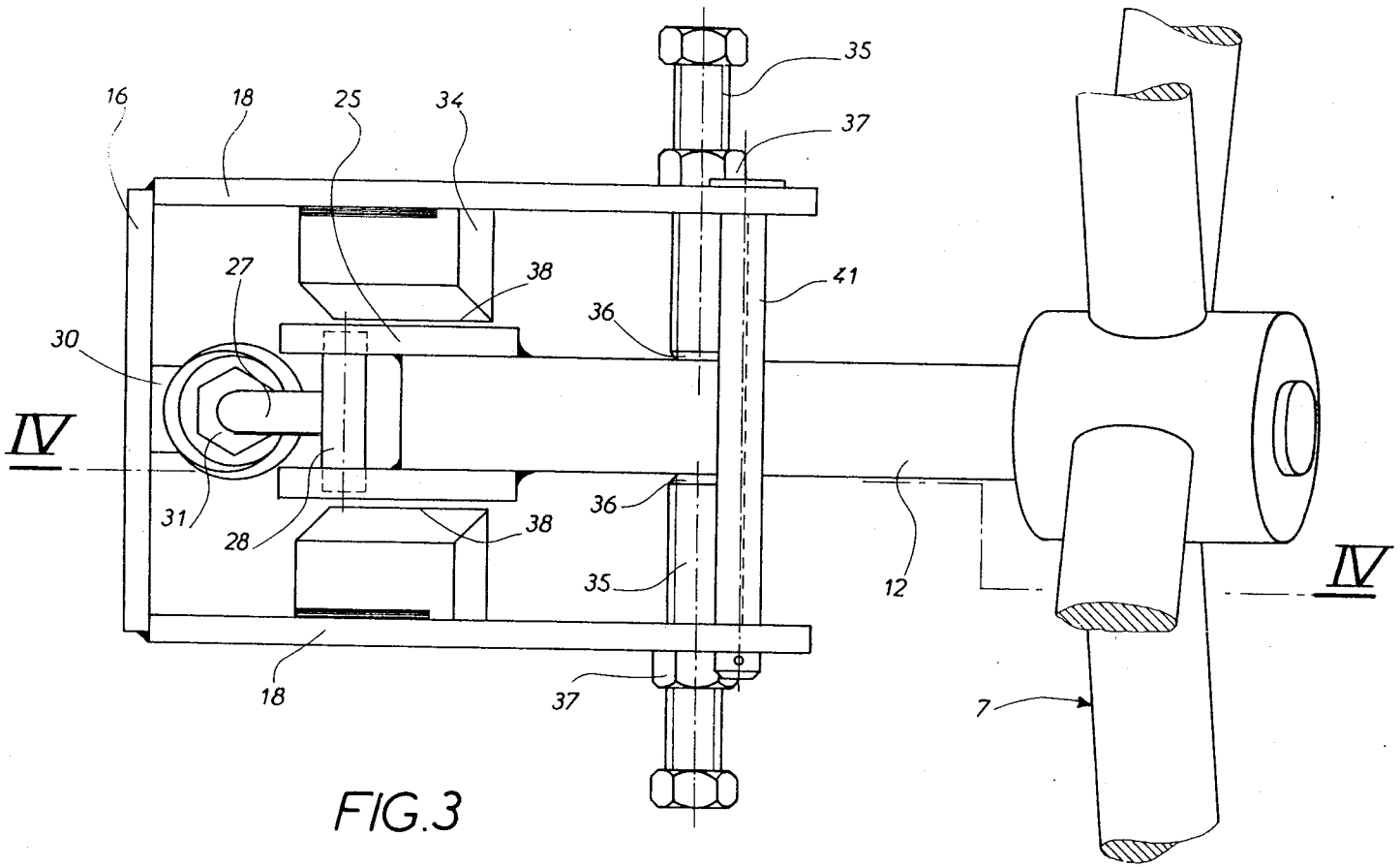
FIG. 3 is a plan view of the support head represented in FIG. 2.
Figure 4:
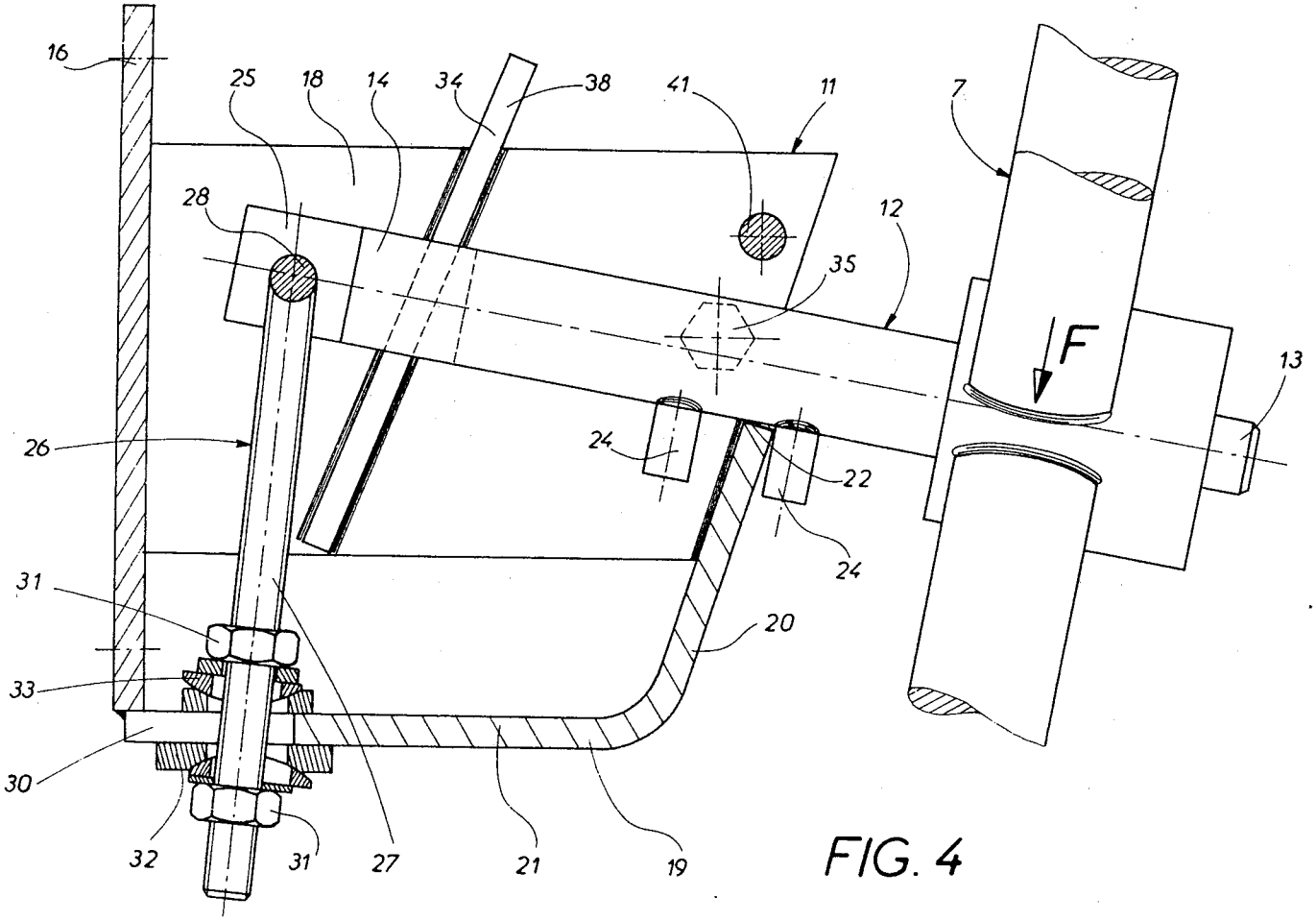
FIG. 4 is a vertical sectional view along the line IV—IV of FIG. 3.

With reference to FIGS. 2 to 4, a support head 5 according to the present invention will be described below in greater detail, which permits the orientation of the pulley axle to be adjusted so as to dispose the pulley groove in a plane defined by the layout of the cable. This support head comprises a rigid frame 11, a pulley axle 12 having its front extremity 13 outside the frame 11 and its rear extremity 14 within the frame, as well as mechanical means for supporting and adjustably orienting the pulley axle 12 with respect to the frame 11.

In the example represented, the frame 11 is advantageously made of welded sheet metal. It comprises a rear plate, pierced with several holes 17 bolting it to a fixed construction, for example to the elbowed arm 3 represented in FIG. 1, two lateral plates 18 perpendicular to the rear plate 16 and a bent plate 19 constituting at the same time a frontal plate 20 and a transverse plate 21 of the frame.

Within the frame, the pulley axle 12 has a square cross-section, while its front extremity is cylindrical. The pulley 7 is rotatably mounted on this extremity 13 as in known realizations. The lower face of the pulley 12 is pressed, by the weight of the pulley and particularly by the load exerted by the cable, on the upper edge of the frontal plate 20. This edge thus forms a first bearing edge 22 for the pulley axle 12. The lower face of the pulley axle comprises two studs 24 which are disposed on each side of the first bearing edge 22 and which serve to retain the pulley axle 12 in the longitudinal direction. It is understood that this pair of studs 24 may be replaced by other means for abutment against the edge 22, for example by a transversal groove in the lower face of the pulley axle.

The rear extremity 14 of the pulley axle 12 comprises a fork 25 on which a tie rod 26 is articulated around a transversal axis. The tie rod 26 essentially comprises a threaded rod 27 having one extremity which is solid with a transversal cylindrical bar 28 pivotally mounted in the fork 25 of the pulley axle. The other extremity of the threaded rod 27 is placed in an opening 30 provided in the transverse plate 21 of the frame. The threaded rod 27 carries a nut 31 on each side of the opening 30. Two sets of articulating washers 32 and 33 are respectively inserted between the nuts 31 and the transverse plate 21 of the supporting member, so as to permit fixing the longitudinal position of the tie rod 26 by tightening the nuts 31, while allowing a certain margin of orientation of the axis of the tie rod 26. If one turns the nuts 31 in one direction or in the other, one lengthens or one shortens the tie rod 26, thereby pivoting the pulley axle 12 on a first pivoting axis 23 which is situated at the first pivoting edge 22. In the position of the support head 5 here illustrated, this first pivoting axis is horizontal.

To maintain and orient the pulley axle 12 in a plane parallel to the first bearing edge 22, the support head is equipped with a guiding fork 34 disposed near to the rear end 14 of the pulley axle and with two opposed lateral screws 35 which are parallel to the first bearing edge 22 and are placed near to this edge so that their respective extremities 36 may abut against the lateral faces of the pulley axle 12. The lateral screws 35 are engaged in threaded holes provided respectively in the lateral plates 18 of the frame and they may be locked by means of respective counter-nuts 37.

The guiding fork 34 is solid with the frame 11. In the example here represented, it consists of two sheet metal plates disposed in a plane approximately perpendicular to the mean direction of the pulley axle 12 and each welded onto one of the lateral plates 18 of the frame 11. In each of these plates, the edge situated near to the lateral face of the pulley axle 12 is cut with a sloping edge, so as to provide against the pulley axle a bearing edge 38 which is orthogonal with the first bearing edge 22. Thus, when the lateral screws 35 are made to turn, the pulley axle 12 slides laterally on the first bearing edge 22 and it thus pivots on a second pivoting axis 40 (FIG. 2) which is in the same plane as the two bearing edges 38, halfway between the latter. Consequently, this second pivoting axis is orthogonal with the first. Finally, to prevent the pulley axle 12 from being accidentally lifted and the studs 24 from being able to pass over the first bearing edge 22, the frame 11 is equipped with a locking bar 41 removably fixed above the pulley spindle 12 and parallel to the first bearing edge 22.

The operation of the support head according to the invention is clearly apparent from the drawings. In the example here illustrated, the force exerted by the cable on the pulley 7 is directed essentially downwards, as represented by the arrow F in FIG. 4. The support head 5 is arranged in such a manner that the first bearing edge 22 is substantially orthogonal with this force, so that it supports the major part of the load exerted on the pulley and that the component of this load parallel to this edge is relativaly small. As the pulley is placed relatively near to the first bearing edge 22 constituting the first pivoting axis, it exerts a moderate pull on the tie rod 26.

One may hence easily adjust the length of this tie rod by turning the nuts 31, which makes the pulley axle 12 pivot the pulley itself pivote on the first pivoting axis 23. During this movement, the rear extremity 14 of the pulley axle 12 slides between the two bearing edges 38 of the guiding fork 34, without the pulley spindle pivoting on the second pivoting axis 40. Once the inclination of the pulley axle 12 is correct, one may adjust its orientation around the second pivoting axis 40 by acting on the lateral screws 35. During this movement, the rear extremity 14 of the pulley axle is displaced very little, since it is maintained in position between the two bearing edges 38. Consequently, the tie rod 26 only pivots by a very small angle about its point of fixation in the transverse plate 21 of the frame; this slight pivoting is permitted by the articulating washers 32 and 33. It will be remarked that while the pulley axle 12 is pivoting on the second pivoting axis 40, its inclination is not modified.

Once the position of the pulley axle 12 is correct, it is locked by locking the nuts 31 of the tie rod 26 and the counter-nuts 37 of the lateral screws 35.

It is apparent from the preceding description that the construction of the support head according to the invention is particularly simple and only comprises inexpensive elements. It moreover allows an adjustment of the orientation of the pulley to be effected without great effort, by means of a simple wrench. The fact that this adjustment can be effected without slackening the cable, and even while the installation is in operation, constitutes a very important advantage. In the case where the installation comprises guide horns 44 which are fixed at the front extremity of the pulley axle, as shown in FIG. 1, these horns are automatically oriented at the same time as the pulley.

It should be likewise remarked that the support head according to the invention may be disposed in any position, for example in such a manner as to support a substantially horizontal pulley. The frame 11 will preferably be disposed so that the first bearing edge 23 is substantially orthogonal with the direction of the load exerted by the cable on the pulley.

The frame construction such as described above may undergo numerous modifications, depending for example on the loads to be supported, on its incorporation in the support of the conveyor installation or on particular mounting or working conditions. This frame may be particularly designed as an integral part of a support arm or a bracket.

It is on the other hand likewise possible to provide a frame in which the two perpendicular pivoting axes are practically concurrent and are both at the front of the frame, while the rear extremity of the pulley axle is connected to two tie rods which are approximately parallel to these two axes. The pulley axle may for example rest in a notch provided in the frontal plate of the frame and functioning as an articulated bearing. However, this solution is mechanically more complicated. Moreover, when the pulley axle occupies a position in which the two tie rods are not perpendicular to each other, an adjustment of the length of one of the tie rods affects the adjustment effected by means of the other.

A pulley support head according to the present invention may be utilized in any cable conveyor installation, for example a ski tow, a building site cableway or a transport installation for the circulation of loads in a factory or in open air, in particular when the cable layout plan has angles, that is to say requires the utilization of inclined pulleys.

The present invention is not limited to the embodiments described above but extends to any modification or variant obvious to one skilled in the art.

I claim:

1. A support head of a pulley having a cable passing over said pulley in a cable conveyor, said support head comprising a rigid frame and a pulley axle supported by said frame, a first extremity of said axle being outside said frame and rotatably mounting said pulley, said frame being fixed and including mechanical means for pivoting said axle with respect to said frame on two substantially orthogonal pivoting axes, said pivoting axes being defined by bearing edges integral with said frame, a first said bearing edge being located in a front part of said frame adjacent said pulley, and said mechanical means for pivoting said pulley axle on a first said pivoting axis comprising a tie rod connected to said frame and to a second extremity of said pulley axle, and means on said tie rod for adjusting the length thereof and locking said tie rod.

2. The support head claimed in claim 1, wherein said pulley axle has a square cross-section in the region of said bearing edges.

3. The support head claimed in claim 2, wherein stop means are provided on said pulley axle disposed on each side of said first bearing edge which are brought into engagement against said bearing edge for fixing the longitudinal position of said pulley axle.

4. The support head claimed in claim 1, wherein said tie rod comprises a threaded portion having one extremity articulated on said second extremity of said pulley axle and another extremity placed in an opening provided in an element of said frame, and wherein said means for adjusting the length of and locking said tie rod comprise two nuts mounted on said threaded portion of said tie rod whereby to hold said element of said frame.

5. The support head claimed in claim 1, wherein said second pivoting axis is defined by a guiding fork which is secured to said frame and includes two parallel bearing edges substantially orthogonal with said first bearing edge and disposed respectively on both sides of said pulley axle for contact with lateral faces thereof, and wherein said mechanical means for pivoting said pulley on said second pivoting axis comprise at least one lateral screw connecting said pulley axle to said frame.

6. The support head claimed in claim 5, wherein said guiding fork is disposed adjacent said second extremity of said pulley axle, and wherein said mechanical means for pivoting said pulley axle on said second pivoting axis comprise two opposed lateral screws mounted in threaded holes in said frame, said screw being parallel to and adjacent said first pivoting axis, the respective extremities of said lateral screws bearing upon said lateral faces of said pulley axle.

7. The support head claimed in claim 1, wherein said frame is made entirely of welded and bent sheet metal.

8. The support head claimed in claim 7, wherein said rigid frame has a generally box-like configuration surrounding said second extremity of said pulley axle and comprises a rear plate, means for securing said rear plate to a fixed support, two lateral plates perpendicular to said rear plate and secured to edges thereof, a frontal plate secured to said lateral plates, and at least one transverse plate integral with said frontal plate, and wherein an edge of said frontal plate constitutes said first bearing edge.

9. The support head claimed in claim 1, wherein said rigid frame has a generally box-like configuration surrounding said second extremity of said pulley axle and comprises a rear plate, means for securing said rear plate to a fixed support, two lateral plates perpendicular to said rear plate and secured to edges thereof, a frontal plate secured to said lateral plates, and at least one transverse plate integral with said frontal plate, and wherein an edge of said frontal plate constitutes said first bearing edge.

* * * * *